United States Patent [19]

Trummer

[11] Patent Number: 4,675,223

[45] Date of Patent: Jun. 23, 1987

[54] STRUCTURAL ELEMENT FOR TILED STOVES

[76] Inventor: Erwin Trummer, Bahnhofstr. 25, A4150 Rohrbach, Austria

[21] Appl. No.: 838,115

[22] Filed: Mar. 10, 1986

[30] Foreign Application Priority Data

Apr. 30, 1984 [AT] Austria ..... 1426/84

[51] Int. Cl.[4] ..... B32B 3/14; F23M 5/02

[52] U.S. Cl. ..... 428/53; 428/54; 428/57; 110/336; 432/247

[58] Field of Search ..... 110/336; 432/247; 428/54, 57, 53

[56] References Cited

U.S. PATENT DOCUMENTS 1,657,453 1/1928 Boyd ..... 110/336 X

*Primary Examiner*—Alexander S. Thomas

*Attorney, Agent, or Firm*—Salter & Michaelson

[57] ABSTRACT

A structural element for more rapidly erecting a tiled stove comprises a quadrangular tile and a quadrangular separate element associated to this tile. The tile has a tile leaf, at the inner side of which a tile body is disposed being unitary with the tile leaf. Two adjacent tiles confine a vertical groove, preferably having a dove-tail cross section, which groove is completely filled by a protrusion of the separate element, which protrusion protrudes from the outer side of a plate of the separate element which plate covers substantially the half of the inner surface of two adjacent tiles each.

8 Claims, 4 Drawing Figures

FIG. 1
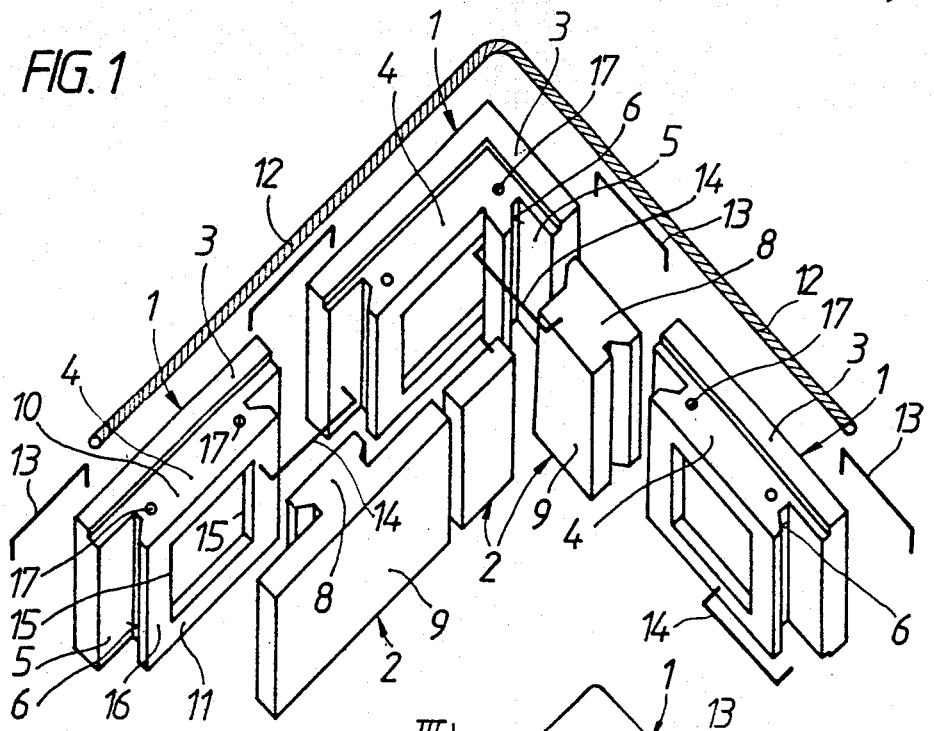
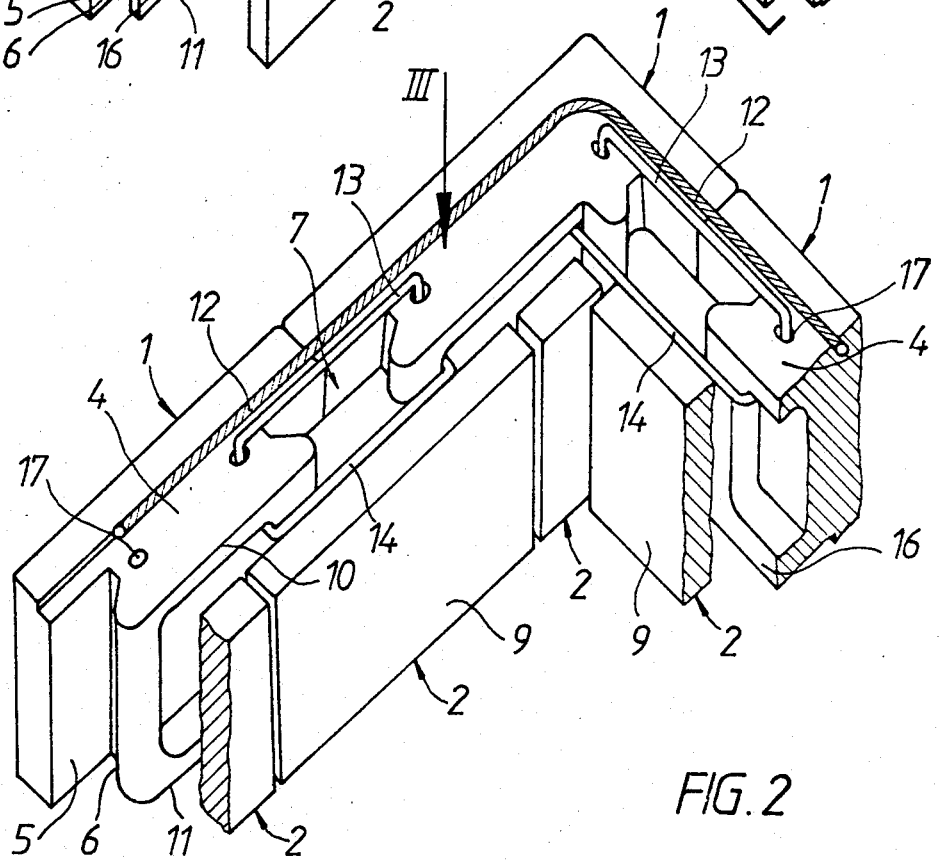
FIG. 2

STRUCTURAL ELEMENT FOR TILED STOVES

BACKGROUND OF THE INVENTION

The invention relates to a structural element for tiled stoves, having a quadrangular tile and a separate quadrangular element of a refractory material associated with this tile, the tile having a tile leaf and a tile body joined thereto, said tile body having surface portions provided on two opposing side surfaces and backwardly retracted relative to the circumference of the tile leaf and passing over into protruding surface portions arranged on that side of the tile body not facing the tile leaf, so that two adjacent tiles form a vertical groove between these surface portions, said groove having a cross section when taken perpendicularly to its longitudinal direction, enlarging in direction towards the tile leaf.

Tiled stoves are most frequently erected by placing usual stove tiles on mortar and by filing the interstices with loam or clay and pieces of brick. The operation is very time-consuming, because a potter and his assistant need approximately eight hours for establishing one square meter tile surface area.

THE STANDARD OF ART

It has been tried to erect tile stoves without any connecting compound. Such a proposal contemplates to design the tile body in the shape of two ribs symmetrically bent in direction to the center portion under an acute angle, thus forming between the ribs of each tile a groove shaped like a dove-tail. The ends of similar tile elements or of bricks designed in a similar manner are suspended into said grooves in the manner of a toothing. This has the disadvantages that, above all, the innermost element is subjected to tension stresses and is thus subjected to an increased load, inasmuch as heat dilatation tensions are inavoidable when operating a tiled stove. Thus the tiles break already after a short period and untight areas are generated in the tile stove. Furthermore this known system does not allow to provide the tiles with a depression which is present in so-called tray tiles.

It has been further already proposed to cover a stove with tiles. In this construction, two adjacent tiles confine a dove-tail groove into which a separate element of refractory material can be inserted. This element serves for the purpose to provide for an adhesion surface for a filling material by which the gaps between adjacent tiles are filled out. This filling out of the gaps between adjacent tiles is time-consuming and troublesome. Further, by this known construction only the tile cover of the tiled stove but not its interior construction confining the combustion chamber and the heating flues can be built up.

SUMMARY OF THE INVENTION

It is therefore an object of the invention to provide for a double-layer structural element for tiled stoves with which a tiled stove can be more rapidly erected, substantially omitting the time-consuming manipulation of placing the tiles on mortar and substantially omitting filling remaining interstices as well as excessive tension forces acting on the element.

The invention substantially consists in that a structural element for tiled stoves comprising a quadrangular tile and a separate quadrangular element of refractory material, are constructed so that the separate element has a plate member adapted to be arranged at the rear side of the tile body of the tiles, said plate member carrying a protrusion which can be shifted into said groove so that the lateral surfaces of the protrusion extend behind said protruding surface portions of the tiles. On account of this special shape of the tiles and of the separate elements coordinated to these tiles, the tiled stove can be erected according to the so-called pinning process, thereby substantially avoiding the use of mortar or the necessity to fill remaining gaps or interstices. The separate plate elements are substantially free of tension stresses and the required consistency of adjacent structural elements can be achieved by usual wire clamps inserted into the tiles. For the purpose of securily tightening adjacent rows of tiles or layers of tiles, respectively, asbestos cords or the like can be used. A further advantages of the structural element according to the invention resides in that in a tiled stove erected by using such structural elements, the heat transport from the hearth and from the heating flues, respectively, in direction to the tile skin located at the outer side takes place more rapidly than with other constructions, because the insulating intermediate layer of loam or clay and pieces of brick is omitted.

According to a further development of the invention the arrangement is such that the protrusion completely fills the cross section of the groove. This results in a particularly reliable fit of the inwardly located separate element within the tiles, avoiding any outward or inward cambering of the surface of the tiled stove. It is particularly favourable if, according to a further feature of the invention, the protrusion is designed as a rib extending over the height of the separate element, because in this manner identical conditions are provided at any height level of the separate element and the minimum cross section area of the protrusion attains a maximum length. It is thus made possible to design, within the spirit of the invention, the groove and the protrusion in the shape of a dove-tail, which results in a particularly well interengaging lever action of the cooperating structural parts and which further has the advantage that small manufacturing tolerances are automatically compensated.

As already mentioned, the resistivity of the construction according to the invention is obtained by means of wire clamps which easily resist the occuring heat stress. According to the invention, the arrangement is conveniently such, that the protrusion forms a resting surface for a wire clamp and being anchored with its ends in that both tiles which confine the groove accommodating the protrusion. This resting surface of the wire clamp facilitating assembling of the tiled stove, because the wire clamp is now reliable supported by the protrusion and thus can not unintentionally fall out of its seat. In this case and according to the invention, the arrangement is in an advantageous manner such, that each end of the wire clamp contacts the inner wall of the tile body designed as a frame, the lateral outer walls of this frame forming the protruding surface portion. By this frame-like construction or by the recess enclosed by the frame, respectively, the weight of the tiles is reduced and an anchoring means for the wire clamps is simultaneously provided in a simple manner. Additional wire clamps as well as tightening cords for tightening adjacent rows of tiles can be accomodated within cavities which are formed on account of the fact that the cover wall and the bottom wall of the frame are inwardly retracted relative to the edge of the tile leaf.

BRIEF DESCRIPTION OF THE DRAWINGS

An embodiment of the invention is schematically illustrated in the accompanying drawings.

FIG. 1 shows an exploded view of a row of the inventive structural elements used for erecting a tiled stove.

FIG. 2 shows in a perspective view the structural elements in assembled condition.

BRIEF DESCRIPTION OF THE PREFERRED EMBODIMENT

Figure 3:
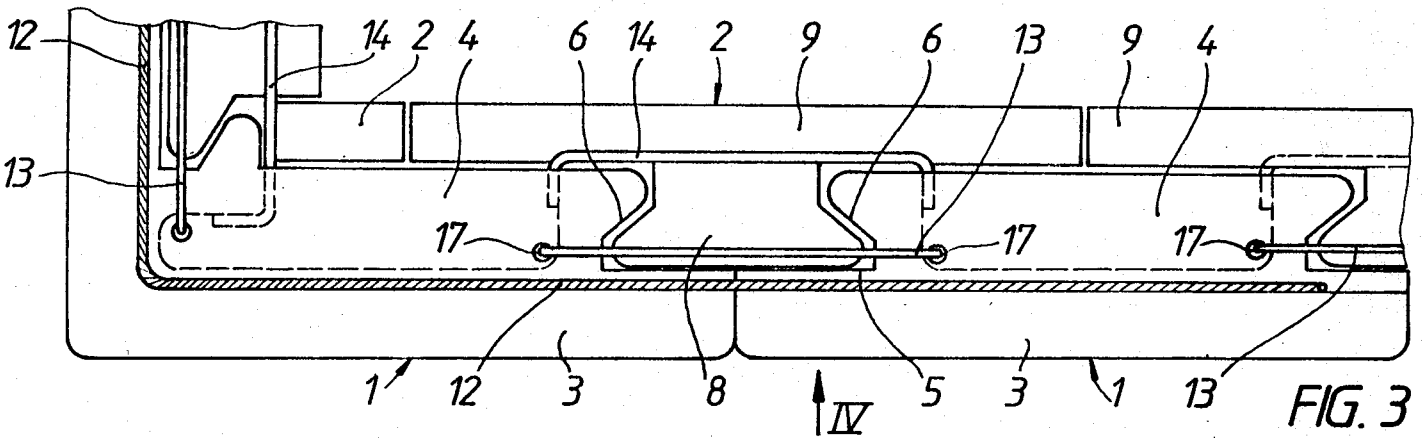
FIG. 3 shows a view in direction of the arrow III of FIG. 2.
Figure 4:
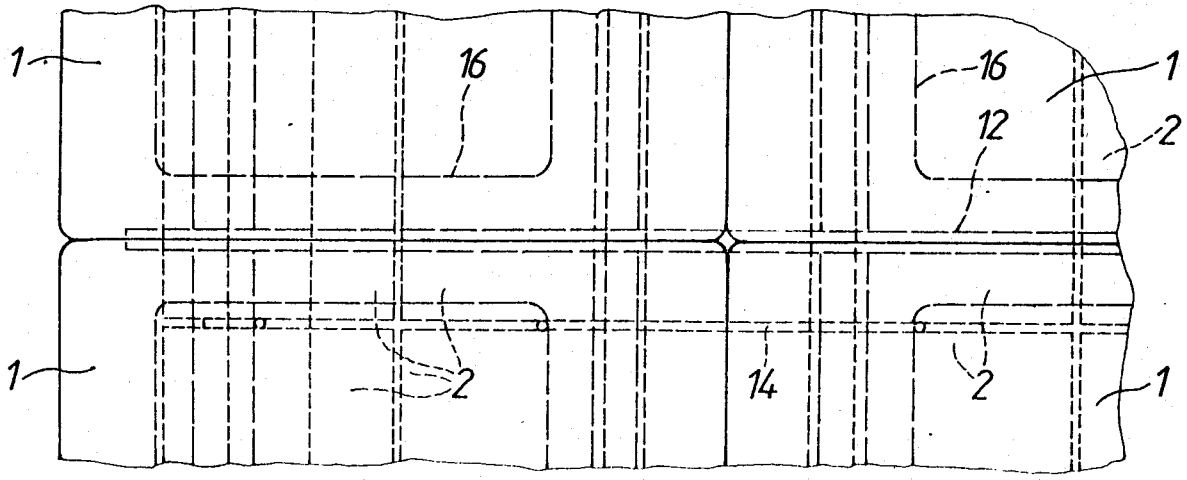
FIG. 4 shows, in a view taken in direction of the arrow IV in FIG. 3, a section of the tile skin of the stove.

The tiled stove is substantially built up of rectangular tiles 1 and rectangular separate elements 2 made of fire-clay associated with the tiles 1. These tiles 1 and elements 2 preferably constitute not only the tile skin of the stove but also at least some of the constructional parts confining the heating flues conducting the combustion gases. Each tile has a tile leaf 3 on the front side thereof and having integrally formed to its inner side a tile body 4. The tile body has at two opposed front groove or vertical side edges surface portions 5 backwardly retracted relative to the circumference or front side of the tile leaf 3 and passing over into rear groove or protruding surface portions 6 located at the inner side (that is the side not facing the tile 1) of the tile body. The surface portions 5, 6 of two adjacent tiles 1 define fine a vertical groove 7 (FIG. 2) having a forwardly increasing width which extends over the total height of the tiles 1 and has a constant dovetail-shaped cross section over its height. A protrusion 8 having equally a dovetail-shaped cross section, of the element 2 can be inserted with proper fit into this groove 7, so that the inserted protrusion 8 substantially completely fills the groove 7 accommodating this protrusion 8. The protrusion 8 is designed as a rib extending over the whole height of the element 2 and being integrally formed with a plate member 9 of the element 2. The height and width of this plate member 9 and of the whole element 2 is equal the height or width, respectively, of the tile leaf 3, whereas the plane top wall 10 of the tile body 4 and its equally plane bottom wall 11 are somewhat retracted relative to the circumference of the tile leaf 3, so that at the horizontal joint area of adjacent rows of tiles there are formed cavities having the shape of horizontally extending gaps serving the purpose of receiving sealing cords 12 made of asbestos or the like and providing tightness against combustion gases and further serving the purpose of receiving wire clamps 13 securing the assembled tiles against tension forces. These wire clamps 13 are inserted with their bent ends into holes 7 provided at the top wall 10 of the tile body 4 and connect two adjacent tiles 1 one with the other. Further wire clamps 14, serving the purpose of increasing the assembly of tiles against tension forces, are put with their center portion onto the protrusions 8 of the elements 2 and snap with their bent legs into the tile body 4 which is designed as a frame, said legs of the wire clamps 14 engaging the inner walls 15 of the frame 16 and being reliably anchored at this place. In order to enable this in each row the elements 2 are somewhat downwardly displaced relative to the associated row of tiles 1 (FIG. 4). Thereby simultaneously the combustion gas tightness of the wall of the tiled stove is increased.

The tiles 1 can be cast or formed in a manner known per se from a mixture of clay and fire-clay. Thus it is easily possible to simultaneously form the retracted surface portions 5 and the surface portion 6 obliquely protruding like a roof, as well as the frame 16 which forms with its outer walls the protruding surface portions 6. The holes 17 can easily be punched when producing the tiles 1. It is easily possible to provide the tiles 1 with recesses or embossings, for example like so-called tray-tiles. The fireclay elements 2 can be extruded elements or elements formed under pressure within a mould.

The Figures of the drawings show tiles 1 for a plane wall portion of the tiled stove as well as a corner piece consisting of a normal tile 1 and a tile half integrally formed thereto at a right angle. The construction principle of the corner piece is substantially identical with that of the normal tiles 1. Behind the corner piece, there is located an element 2 of reduced width but being in its construction principle otherwise identical with that of the normal elements 2, however, in connection with this element 2 of reduced width, the protrusion 8 has approximately the same width as the plate member 9.

When erecting the wall of the tiled stove, the tiles are placed along rows, whereupon the protrusions 8 of the elements 2 are inserted into the grooves 7 from the top. The elements 2 cover with their plate members 9 of half each of the inner side of the two associated tiles 1 but are downwardly displaced relative to the tiles 1 for approximately the width of the web of the frame 16 (FIG. 4). The remaining gaps at the corner tiles are filled by narrower strips of fire-clay. Subsequently, the wire clamps 13 are inserted from the top into the holes 17 and the wire clamps 14 are placed on the top surfaces of the protrusions 8 and are pushed with their ends into the openings of the frame 16 of two adjacent plate members each. In this manner, the assembly of the tiles 1 is made resistant against tension forces. Any lateral evading is thus impossible. Also any outward or inward vaulting is made impossible by the interengaging dovetail-shaped cross section of the groove 7 and the protrusion 8, respectively, and by the thus obtained lever actions. After having inserted sealing cords 12 into the cavity constituted by the retracted top surface 10 of the tile body, and, if desired, onto the top surface of the elements 2, the next row of tiles or of the elements 2, respectively, can be placed in position. On account of the system comprising constructional units, it is possible to realize any desired shape according to the requirements as well as to incorporate any desired internal construction of the tiled stove.

The inner walls 15 which define the recess 18 of the frame 16, conveniently extend perpendicularly to the front plane of the tile leaf 3, so that the end portions of the clamps 14, being bent at a right angle and contacting the inner walls 15 and inserted into these recesses 18, can not slide off the inner walls 15.

The recesses 18 are preferably of rectangular shape and may have rounded corners and can, when erecting the tile stove, be filled with bricks of fire-clay having a suitable fit.

For increasing the tightness against combustion gases, elastical gap-filling materials known per se can be used in addition to the sealing cords 12, preferably consisting of asbestos, so that the whole construction remains expandable and can well accommodate any heat stresses occurring during operation.

The tightness as well as the stability can further be increased if, in particular within the combustion chamber and within the first heating flues, plate members of fireclay are additionally provided at the inner side of the elements 2.

What is claimed is:

1. A structural element for tiled stoves comprising in combination a quadrangular tile and a quadrangular separate element made of a refractory material, said tile including a tile leaf on the front side thereof for forming an outer surface of a stove and a tile body joined to the tile leaf, said tile body having front groove surface portions on two opposite sides thereof which are spaced rearwardly from the tile leaf thereof and pass into rearwardly protruding rear groove surface portions, said tile being constructed so that it is receivable in an assembled relation with another tile of similar configuration wherein the lateral side edges of said tiles are in engagement and wherein the adjacent front and rear groove surface portions of said tiles cooperate to define a vertical groove therebetween having a forwardly increasing width, said separate element including a plate member which is of substantially the same dimension and configuration as said tile leaf and which is receivable adjacent the rear sides of the tile bodies of said tiles when said tiles are in said assembled relation and a protrusion which is receivable in said groove so that the lateral side edge portions of said protrusion are received between the respective adjacent front and rear groove surface portions of said groove.

2. A structural element as claimed in claim 1, wherein said protrusion is centrally arranged on said plate member so that when said tiles are in said assembled relation the plate member extends over half of both of said tiles.

3. A structural element as claimed in claim 1, wherein the protrusion completely fills the cross section of the groove.

4. A structural element as claimed in claim 1, wherein the protrusion is designed as a rib extending over the whole height of the plate member.

5. A structural element as claimed in claim 1, wherein the groove and the protrusion have a dovetail-shaped cross section.

6. A structural element as claimed in claim 1, wherein the protrusion forms a supporting surface for a wire clamp being anchored with its ends within that both tiles which form the groove receiving the protrusion.

7. A wall structure for tiled stoves comprising a plurality of rows of the structural elements of claim 1, the tiles in each row being received in said assembled relation, one of said separate elements being assembled with each pair of assembled tiles so that the protrusion of each separate element is received in the groove defined by its respective pair of assembled tiles, said rows being disposed one on top of another to define a substantially vertical wall, the separate elements in each row being vertically offset with respect to the tiles in the same row.

8. A structural element for tiled stoves comprising in combination a quadrangular tile, a quadrangular separate element made of a refractory material and a wire clamp, said tile including a tile leaf on the front side thereof for forming an outer surface of a stove and a tile body joined to the tile leaf, said tile body being formed as a rearwardly facing frame and having front groove surface portions on two opposite sides thereof which are spaced rearwardly from the tile leaf thereof and pass into rearwardly protruding rear groove surface portions, said tile being constructed so that it is receivable in an assembled relation with another tile of similar configuration wherein the lateral side edges of said tiles are in engagement and wherein the adjacent front and rear groove surface portions of said tiles cooperate to define a vertical groove therebetween having a forwardly increasing width, said separate element including a plate member which is of substantially the same dimension and configuration as said tile leaf and which is receivable adjacent the rear sides of the tile bodies of said tiles when said tiles are in said assembled relation and a protrusion which is receivable in said groove so that the lateral side edge portions of said protrusion are received between the respective adjacent front and rear groove surface portions of said groove, said protrusion forming a supporting surface for said clamp, said clamp having opposite ends which are securable to the bodies of said tiles when said tiles are received in assembled relation, the frames of the bodies of said tiles having inwardly facing surfaces which are substantially perpendicular to the front surfaces of their respective tile leaves and which are engageable with the respective adjacent ends of said clamp to secure said tiles in said assembled relation.

* * * * *